United States Patent [19]

Haddock

[11] 4,117,939

[45] Oct. 3, 1978

[54] MOVEABLE BUILDING BOARD HOIST

[75] Inventor: Elvin D. Haddock, Phoenix, Ariz.

[73] Assignee: Yuma Desert Manufacturing, Inc., Yuma, Ariz.

[21] Appl. No.: 537,864

[22] Filed: Jan. 2, 1975

[51] Int. Cl.[2] ..... B66F 9/12

[52] U.S. Cl. ..... 214/1 SW

[58] Field of Search ..... 214/1 R, 103, 1 SW, 214/1 S, 1 Q, 650 R, 650 SG, 46.28, 46.24, 313; 187/2

[56] References Cited

U.S. PATENT DOCUMENTS

| | | | |
|---|---|---|---|
| 735,965 | 8/1903 | Gillfoy | 214/46.28 |
| 2,828,869 | 4/1958 | Corley | 214/1 SW |
| 3,019,914 | 2/1962 | Taylor | 214/1 SW |
| 3,223,199 | 12/1965 | Schwehr | 214/1 SW X |
| 3,279,635 | 10/1966 | Avery et al. | 214/313 |
| 3,432,911 | 3/1969 | Rodgers | 214/1 D X |
| 3,651,959 | 3/1972 | Castela | 214/1 Q X |

*Primary Examiner*—Frank E. Werner

*Attorney, Agent, or Firm*—Charles E. Cates

[57] ABSTRACT

A hoist for raising building board from the ground to working proximity to a structure to which said board is to be affixed, e.g. a ceiling, has an inclined track which in one embodiment may be curved in such a manner as to allow the board to be loaded on a vertically disposed truck and moved upwardly on the track into position in working proximity to a horizontal working plane without bumping or jostling the board against the structure.

7 Claims, 4 Drawing Figures

MOVEABLE BUILDING BOARD HOIST

BACKGROUND OF THE INVENTION

This invention relates to improvements in building board hoists, particularly with regard to handling of sheets of material such as gypsum, wood panelling and the like.

In the building industry building board made of gypsum and various materials is widely used. Sometimes referred to as sheet rock, it comes in standard width and length sizes of 4 ft. by 12 ft., the thickness varying from ½ inch to 1 inch. The thicker sheets having greater structural integrity and strength are used on larger structures. The weight of sheet rock is a serious problem in handling it, a 4 ft by 12 ft sheet ½ inch thick, for example, weighing 112 pounds. In order to enable men to apply sheet rock to high ceilings scaffolding must be erected and the building board must be lifted to the structure to which it is to be attached. The handling of sheet rock by the workmen often results in injuries. Neck and back injuries caused by overhead handling of building board materials are prevalent and a costly factor in medical and insurance plans for workmen.

Recognizing such problems the prior art sought to facilitate the overhead handling of building boards by inventing hoists for that purpose. However useful, the prior art hoists are generally complex, expensive machines. Some of them have a tendency to unduly jostle the board and cause expensive breakage. Others do not approach the working surface as closely as desired for ease of handling.

For these and other reasons, a simply constructed, sturdy and inexpensive hoist for placing building board in working proximity to the structure to which it is to be affixed is desired.

DEFINITIONS

As used in this disclosure unless the context otherwise requires:

"Building board" and "board" mean a sheet of building material of any composition including but not limited to wood, plastic, gypsum, composition and laminated materials.

"Vertically disposed" means occupying a vertically oriented position extending from true vertical to 45° from true vertical.

"Horizontally disposed" means occupying a horizontally oriented position extending from true horizontal to 45° from true horizontal.

"Working proximity" means such close proximity to the ceiling or other building structure to which the building board is to be affixed as to enable the workers to secure the board thereto by their own efforts without further mechanical hoisting assistance.

"Track" means any surface capable of supporting a means for carrying building boards including without restriction thereto a flat ramp, a rail, a pipe, a channel, a wire, rope or cable, and all equivalent structures.

"Track profile" means the configuration of the track viewed in side elevation.

SUMMARY OF THE INVENTION

The present invention combines an inclined track in cooperation with means for moving building board on the track in a new and unobvious way such that building board may be conveniently loaded on the moving means, for example, a truck, at ground level at the lower end of the track and smoothly moved on said track to its upper end in working proximity to the structure site.

Conveniently, the track is supported by a frame preferably having wheels for mobility.

The track profile may be single or plural rails and of varying profile configuration, for example, a vertically disposed straight lower end which may incline from true vertical curving into a horizontally inclined straight upper end; alternatively, the lower end or leg may itself be curved continuously merging into a curved upper end or leg, the legs whether straight or curved or a combination of straight and curved being connected integrally by a curved knee or medial portion which may or may not be clearly apparent, an example of the latter case being embodied in the continuously curved lower and upper ends.

Conveniently, a truck may be provided to carry the board, and any convenient means for supporting and engaging the board may be employed, e.g. a flat bed with brackets. The truck is preferably wheeled although runners, glides, yokes and the like can be made to serve. The truck may be self propelled or moved from and between the ends by remote means, as for example a rope and pulley system, hand winched or motor driven.

As mobility of the hoist is desirable, a wheeled frame is preferred. A platform for workmen to stand on may be provided. Preferably the lower end or leg is extendible and the working platform may be adjusted to follow the height of the hoist.

A prominent feature of the invention is the means for raising the board to working proximity to the ceiling plane, whether horizontal or inclined closely enough to permit one man to nail or otherwise affix the board to the ceiling structure. The cooperating elements accomplishing this result are the attitude of adjustment of the board carrying means relative the track profile and inclination. A preferred combination employs a truck which carries the board at an angle to the track, the lower end of the truck as viewed at the lower end of the track being supported more distantly from the track than the upper end. The degree of inclination, if any, of the track from the horizontal and vertical, the radius of curvature of the knee, and the degree of inclination of the board are interdependent variables. They can be adjusted without undue experimentation so that the board is in working proximity to the ceiling when the truck is at the upper end of the track.

Usually it will be desired to have a slightly inclined truck bed having a stop at its lower end for use in loading at ground level. The track will be curved so that the board will rise, turn the knee and come to within a few inches of the ceiling plane substantially parallel thereto. As can be appreciated by one having the benefit of the teaching of this disclosure, the curvature and inclination of the track and the inclination of the truck bed may be easily adjusted to accomplish the purpose. If a wheeled truck is used the wheel base and the track curvature may be adjusted for closer fits.

DRAWINGS

A fuller understanding of the invention can be obtained from a consideration of the accompanying drawings in which.

DETAILED EXPLANATION OF THE PREFERRED EMBODIMENT

Figure 1:
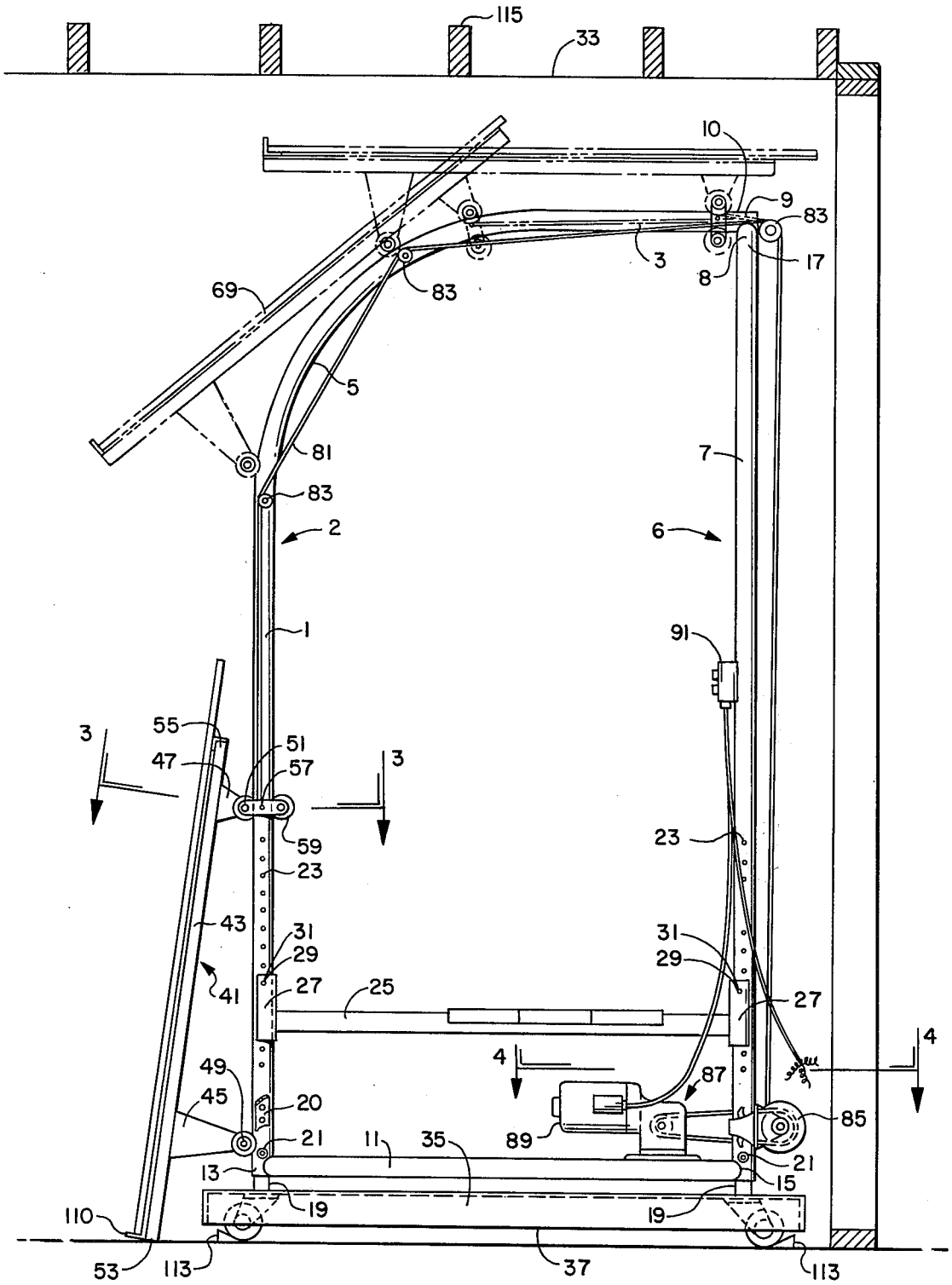
FIG. 1 is a side elevation view of a hoist representing a presently preferred embodiment of this invention and showing the track profile.
Figure 2:
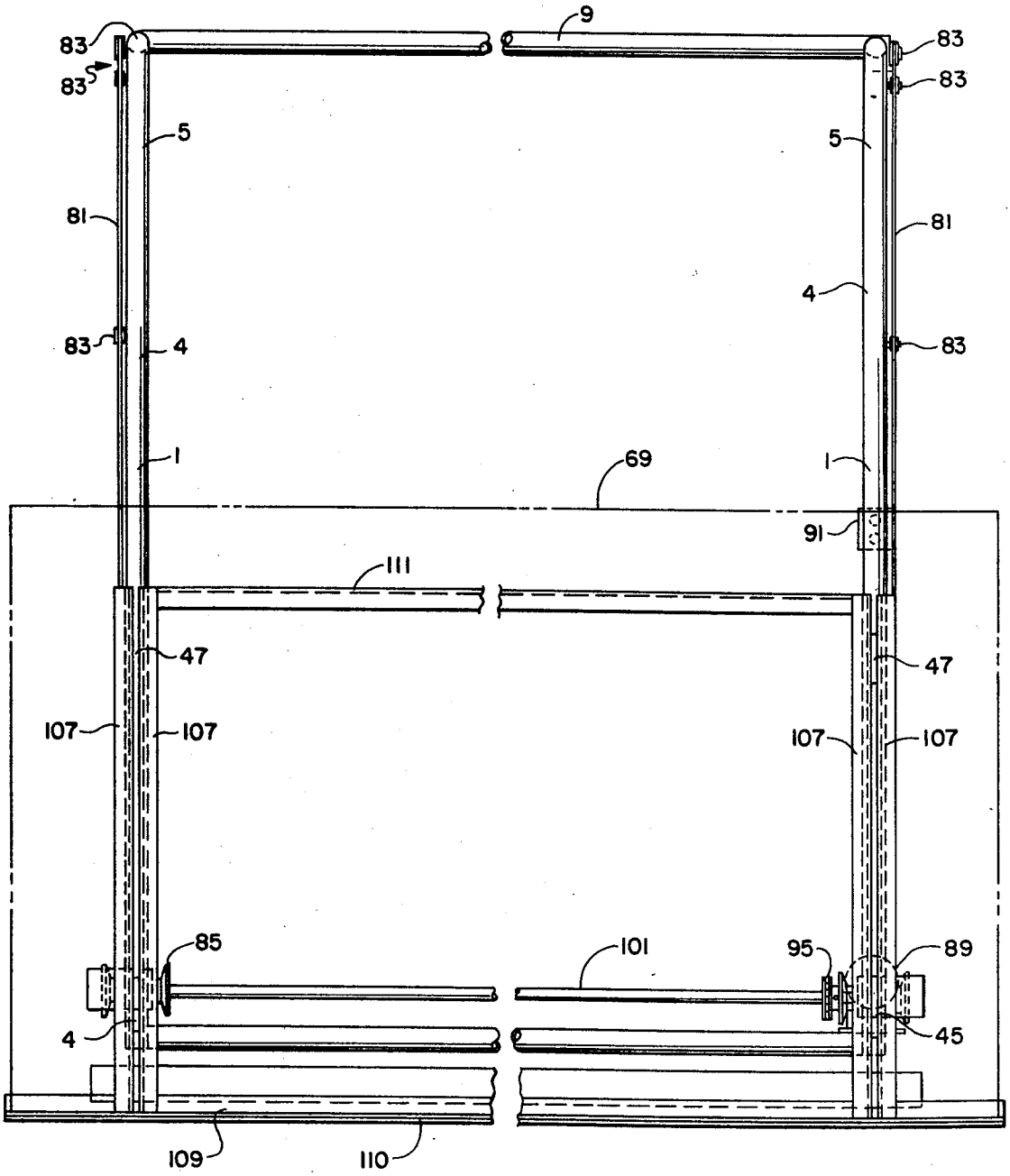
FIG. 2 is a front elevation of the device of FIG. 1.

FIG. 1 illustrates a presently preferred embodiment of the invention wherein the track profile comprises a straight vertical leg 1 and a straight horizontal leg 3 integrally connected by a curved knee 5. Although not visible in the side elevation view of FIG. 1, the track 2 comprises parallel rails 4, as illustrated in FIG. 2, and are constructed of tubular aluminum. It is supported by other structural pieces which generally may be considered the frame 6. Among the frame pieces are a pair of rear posts 7 and a rear stringer 9 welded to the tops 8 of the pair of rear posts 7 and the terminal ends 10 of the horizontal legs 3. Side braces 11 connect the lower ends 13 of the vertical legs 1 to the bottom end 15 of the rear posts 7. The top ends 17 of the rear posts 7 are welded to the terminal ends 10 of the track 2.

Disposed within the tubular vertical leg 1 of the track 2 and the rear posts 7 are standards 19. The standards 19 are perforated 20 to receive the shanks of bolts 21 which are disposed in perforations in the vertical leg 1 and the rear post 7 which register with the perforations of the standards such that the standards may be telescoped within or withdrawn from the vertical leg and the rear post. The height of the device may be adjusted relative the ceiling by raising the vertical leg and the rear post to register with successive perforations in the standards.

Similarly there are a second set of perforations 23 in the vertical leg and rear post for the purpose of providing adjustability to a platform 25 which is suspended by means of brackets 27. These brackets 27 are shaped to closely fit a partial circumference of the tubular vertical leg 1 and rear post 7 and are provided with openings 29 which register with the second set of perforations 23 and which receive pins 31 by which the brackets 27 are suspended. The platform 25 provides a place for workmen to stand at a convenient height to reach the plane of the ceiling 33.

The standards 19 are welded to the frame 35 of a dolly 37 which is provided with wheels 39.

A truck 41 is provided. It has a bed 43, supports 45 and 47 which connect the bed 43 to wheels 49 and 51. As depicted in FIG. 1 the bottom support 45 is longer than the top support 45 which results in carrying the bed 43 at an angle to the track 2, the lower end 53 of the bed 43 being more distant from the track 2 than the upper end 55 of the bed. The upper wheels 51 are connected by straps 57 to retainer wheels 59. As can be more clearly seen in FIG. 3, the wheels 49, 51 and 59 have concave surfaces 61 which closely fit and ride upon the convex surfaces 63 of the tubular outer surface of the track 2.

Figure 3:
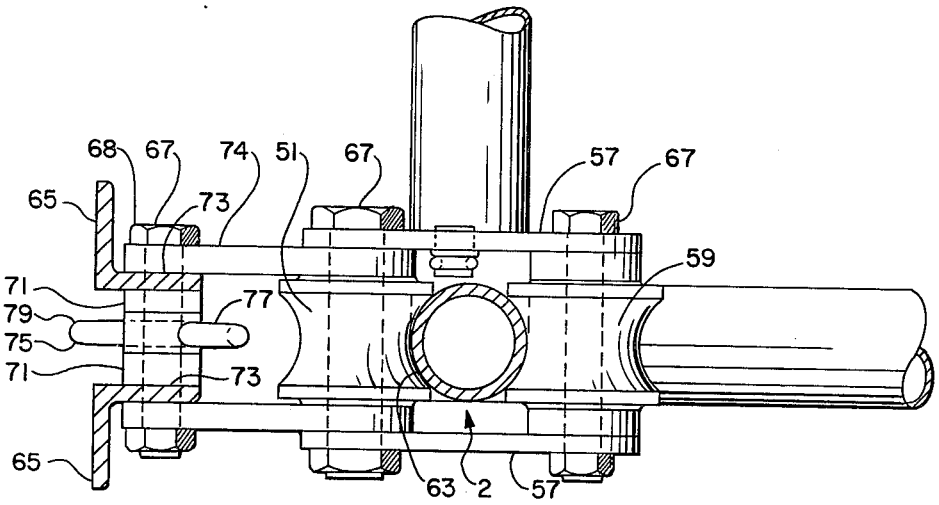
FIG. 3 is a view of an enlarged detail of a portion of the device of FIG. 1, viewed in the direction indicated by the lines 3—3.
Figure 4:
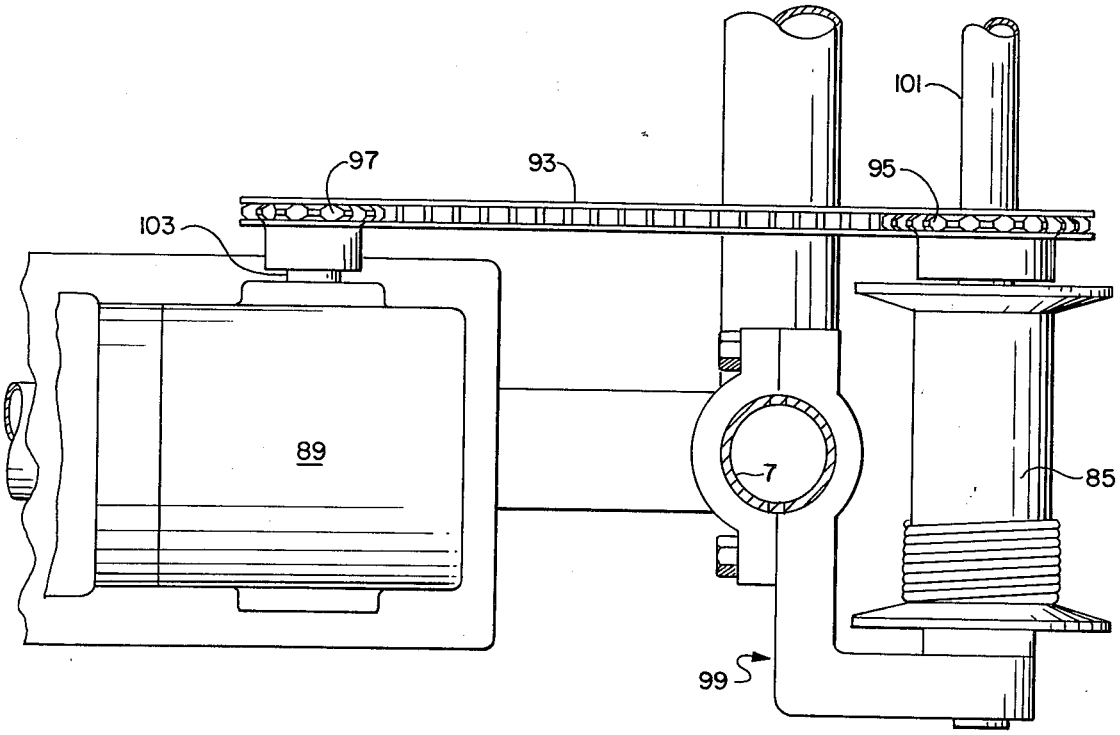
FIG. 4 is an enlarged partial view of the device of FIG. 1 taken in the direction indicated by the lines 4—4.

The wheels 49, 51 and 59, supports 45, 47, straps 57 and mounting bracket 65 are attached by means of bolt assemblies 67 as shown in FIG. 3 which needs no elaboration. However, a refinement of the present invention is illustrated in FIG. 3 and concerns itself with the task of lifting the building board 69 even closer to the ceiling plane 33. To accomplish this the bolts 67 which connect the bottom and top supports 45, 47 to the mounting brackets of the truck 41 are provided with spacers 71 on the bolt 68 intermediate the fingers 73 of the mounting bracket 65. The spacers 71 flank a lever 75 which rotates about the axis of the bolt 68. By pulling down on the handle 77 the lever 75 is rotated and the finger 79 projects between parallel angle irons 107 to lift a corner of the board 69. Returning to FIG. 1 the means of reciprocating the truck 41 on the track 2 is shown generally as a cable 81 coursing over a series of pulleys 83 and being taken up or unwound from a spool 85. The spool 85 is operated by means of a belt and pulley power take-off mechanism attached to a motor 89. The motor is electrically powered and controlled by a switch 91 controlling a source of electrical energy. Details of the power train from the motor to the spool are shown in FIG. 4 where the chain 93 is seen to engage the sprockets 95 and 97 cooperating with the spool 85 and motor 89 respectively. The pulley 85 is mounted by means of a second bracket 99 to the rear post 7 and associated sprocket turned on spindle 101. The motor 89 is similarly mounted by means not shown on side brace 11. The sprocket 97 associated with the motor 89 is driven by power take-off shaft 103.

Turning now to FIG. 2 the details of the bed 43 of the truck will now be considered. As seen the side frame 105 consists of parallel angle irons 107 welded to the truck supports 45, 57 and to the cross bars 109, 111 which are likewise constructed of lengths of angle aluminum. The lower cross bar 109 is disposed in relationship to the side frame such that one leg 110 of the angle iron serves as a stop and support means for the building board 69 shown in dotted lines.

In operation the hoist is wheeled to an appropriate site, chocks 113 are put into place to prevent further movement and the height of the device is adjusted by withdrawing the bolts 21 from their respective holes 22. Adjusting the relationship of the vertical leg and the rear post to the standards 19 and inserting the bolts 21. The platform 25 is similarly adjusted.

Then the building board 69 is loaded on to the bed 43 of the truck 41. The switch 91 is activated which energizes the motor and causes the spool to take up the cable drawing the truck upward along the track 2, rounding the knee and assuming a horizontal position on the horizontal leg 3.

Because of the configuration of the curved knee connecting the vertical leg and the horizontal leg in cooperation with the supports 45, 47 of the truck 41, the building board can be carried around the curved knee 5 without striking the rafters 115. The curved knee in cooperation with the longer support 45 and the shorter support 47 brings the board and the bed of the truck in parallel relationship with the plane of the ceiling 33. From this position one man can push up the board to the ceiling plane for nailing purposes. With this invention the building board can be brought parallel to and within a few inches of the plane of the ceiling. For those who desire mechanical assistance in raising the board to the ceiling plane, the lever 75 may be added to the mechanism as an optional accessory.

Those skilled in the art will perceive from the teachings of this disclosure that the vertical leg and the horizontal leg of the track can easily be inclined from true vertical and true horizontal respectively and may even be curved in whole or part, the controlling consideration being the cooperation between the track profile and the height of the standards 45, 47. All equivalents of this invention which will be apparent from the teachings of this disclosure are intended to be a part of and claimed as a part of this invention although not specifically shown in the various embodiments.

What is claimed is:

1. A moveable building board hoist comprising a track having a vertically disposed leg having a lower end, a horizontally disposed leg having an upper end, a curved knee connecting said legs, support means for supporting said track, means for adjusting the height of said track to working proximity, and motive means for moving and carrying building board from and between said ends comprising a truck having a receiver for the board which carries the board at an angle to the track, the lower end of the board when in the vertically inclined position being more distant from the track than the upper end such that the board is substantially parallel to the plane in which the board is to be permanently affixed when the truck is moved to said horizontally disposed leg of said track, said motive means cooperating with the angle of inclination and height of said track to place said board in working proximity to a horizontally disposed structure to which the board is intended to be affixed when the board is raised to said horizontally disposed leg of said track.

2. The hoist of claim 1 wherein said means for carrying said board comprises a truck having means for engaging said board.

3. The hoist of claim 1 wherein said track comprises a pair of parallel guide rails.

4. The hoist of claim 1 wherein said means for supporting said track is a frame moveably supported by wheels.

5. The hoist of claim 1 wherein a portion of the vertically disposed leg of said track is curved.

6. The hoist of claim 1 wherein said track is curved.

7. The hoist of claim 1 with the addition of means for extending the length of said vertical leg.

* * * * *